US010846993B2

(12) United States Patent
Bridges et al.

(10) Patent No.: US 10,846,993 B2
(45) **Date of Patent: *Nov. 24, 2020**

(54) GAMING MACHINE WITH TIMED GAME OF CHANCE AND SKILL

(71) Applicant: WYMAC GAMING SOLUTIONS PTY LTD, Oakleigh (AU)

(72) Inventors: Daryl Geoffrey Bridges, Selby (AU); Andrew Peter Wyer, Iris (AU); Simon David Riley, Ringwood East (AU); Matthew Moss, Albert Park (AU)

(73) Assignee: WYMAC GAMING SOLUTIONS PTY LTD, Oakleigh (AU)

( * ) Notice: Subject to any disclaimer, the term of this patent is extended or adjusted under 35 U.S.C. 154(b) by 0 days.

This patent is subject to a terminal disclaimer.

(21) Appl. No.: 16/301,784

(22) PCT Filed: May 15, 2017

(86) PCT No.: PCT/AU2017/000107

§ 371 (c)(1),
(2) Date: Nov. 15, 2018

(87) PCT Pub. No.: WO2017/197432

PCT Pub. Date: Nov. 23, 2017

(65) Prior Publication Data

US 2019/0156634 A1 May 23, 2019

(30) Foreign Application Priority Data

May 16, 2016 (AU) ..... 2016901820

(51) Int. Cl.
*G07F 17/32* (2006.01)

(52) U.S. Cl.
CPC ..... *G07F 17/3269* (2013.01); *G07F 17/3213* (2013.01); *G07F 17/3244* (2013.01); *G07F 17/3288* (2013.01); *G07F 17/3295* (2013.01)

(58) Field of Classification Search
CPC ..... G07F 17/00; G07F 17/32
See application file for complete search history.

(56) References Cited

U.S. PATENT DOCUMENTS

2009/0131158 A1* 5/2009 Brunet De Courssou ..... G07F 17/3267 463/26

2010/0120506 A1 5/2010 Davis et al.

(Continued)

OTHER PUBLICATIONS

International Search Report and Written Opinion, PCT/AU2017/000107, dated Aug. 1, 2017 (9 pp.).

*Primary Examiner* — Reginald A Renwick
(74) *Attorney, Agent, or Firm* — Eversheds Sutherland (US) LLP

(57) ABSTRACT

A gaming machine which includes a display unit configured to display a gaming interface, and a score interface; a console for receiving payment instructions from a player; a game controller programmed to present at least one game of chance and at least one game of skill. The machine includes a display controller activated by said game controller to display at least one of a game of chance and one of said game of skill and to display a score and a game timer. The game controller includes a program that runs an algorithm that determines that the long term return to player (RTP) from the gaming machine lies between a minimum specified percentage and a maximum specified percentage. The algorithm includes functions dependent on the random number generator (RNG), the score from the game of skill and the time elapsed during the game of skill.

5 Claims, 5 Drawing Sheets

(56) References Cited

U.S. PATENT DOCUMENTS

| | | | | |
|---|---|---|---|---|
| 2013/0324214 | A1 | 12/2013 | Shaw et al. | |
| 2015/0011290 | A1 | 1/2015 | Galansky | |
| 2018/0012454 | A1* | 1/2018 | Thirumaleshwar | G07F 17/3286 |
| 2019/0096182 | A1* | 3/2019 | Oberberger | G07F 17/3286 |
| 2019/0114878 | A1* | 4/2019 | Bridges | G07F 17/3244 |

* cited by examiner

GAMING MACHINE WITH TIMED GAME OF CHANCE AND SKILL

This invention relates to improvements in electronic gaming machines that use random number generators that provide the basis for games of chance.

BACKGROUND TO THE INVENTION

Most electronic casino games of chance rely on a random number generator to provide the chance outcome for games and on an algorithm that modifies the outcome to provide a return to player within in a specified range. Government regulations will usually set a minimum return to player and the return to the venue is usually determined by setting the upper limit for the return to player value. To make games more interesting it has been proposed to introduce a level of skill into this type of game WO 11/120592 relates to a gaming machine having a base game, being a game of chance, and a feature game, which may be a game of skill. The results of the base game may change the attributes of the characters of the feature game, depending on the symbols displayed on the reels. The attributes of the characters may affect the likelihood of success in the feature game. The game allows the player to choose their character and swap characters at any point of the game.

Patent AU 2011200434 discloses a method wherein a software agent utilised by a player, allows for selection of skill level.

U.S. Pat. No. 8,753,193 discloses a return driven game outcome generator which enables games to measure and reward skill. Participants can purchase a time based contract and rewards are provided when the skill game generates a score. Also the skill game can change the view to provide a full view landscape or the landscape is revealed gradually during the game.

USA application 2013/0178273 discloses a gaming system having a first skilled base game and a number of chance based games triggered by events in the skill game. U.S. Pat. No. 8,986,117 discloses a method of detecting unauthorised use of a hybrid game which consists of an entertainment game and a chance game.

A problem with gaming is to provide interesting rewards in addition to the monetary reward from the game of chance.

A problem in devising games where skill and chance are involved is to maintain the return to player within the desired range while rewarding the skill of the player.

It is an object of this invention to provide a gaming machine that ameliorates this problem.

BRIEF DESCRIPTION OF THE INVENTION

To this end the present invention provides a gaming machine which includes a display unit configured to display a gaming interface, and a score interface;

a console for receiving payment instructions from a player;

a game controller programmed to present at least one game of chance said game controller including a random number generator, a score calculator and a timer;

a display controller activated by said game controller to display said game of chance and to display a score and a game timer;

said game controller including a program that runs an algorithm that determines that the long term return to player from the gaming machine lies between a minimum specified percentage and a maximum specified percentage;

said algorithm including functions dependent on the random number generator (RNG), and the time provided for the game of chance.

The advantage derived from this arrangement is that time becomes a relevant commodity within the game structure by providing a reward of additional time while maintaining the return to player within a desired range.

A player when using the gaming machine will pay for a specified number of game elements. A game element is a game of chance determined by the random number generator. After each game of chance the random number generator incrementally generates another random result and reduces the number of game element credits purchased by the player. Over a specified number of game elements the winnings earned by the player will fall within a predetermined range which has a minimum percentage. By providing time as a reward additional time for playing game elements may be provided to increase the return to player above the minimum percentage. Once time is provided as a reward it can provide alternate games for the player. Games of skill may be provided during this reward time where the player may earn a score that can be used to increase the return to player above the minimum percentage. By introducing the games of skill and providing the time for playing the game of skill, the score earned during the games of skill can be used to increase the return to player above the minimum percentage up to the predetermined maximum percentage. One form of winning is to earn game element credits. Another form of winning which is now possible with this invention, is to provide game time in a game of skill or additional time for playing additional game elements. The score may also be used to provide additional game elements with higher odds.

The game of chance is usually a reels type game where matching icons on a number of spinning reels displayed on the display screen will provide a win value. In this invention a return above the minimum percentage can be provided by rewarding the player with additional game time. The game time can be used in a game of chance or a game of skill.

The game of skill may be a dexterity skill game such as touching various valued moving icons on the screen or a strategy based game such as breaking a code. The game of skill will be displayed as a feature after a series of game elements (the base game) have been played.

The game timer display may take any form that directly or intuitively informs the player of the time available or remaining in the game of skill.

DETAILED DESCRIPTION OF THE INVENTION

Preferred embodiments of the invention will now be described with reference to the drawings in which.

Figure 5:
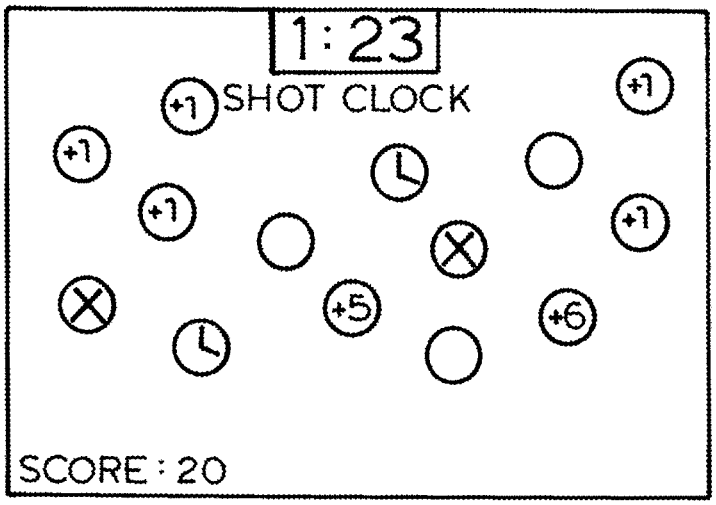
Figure 6:
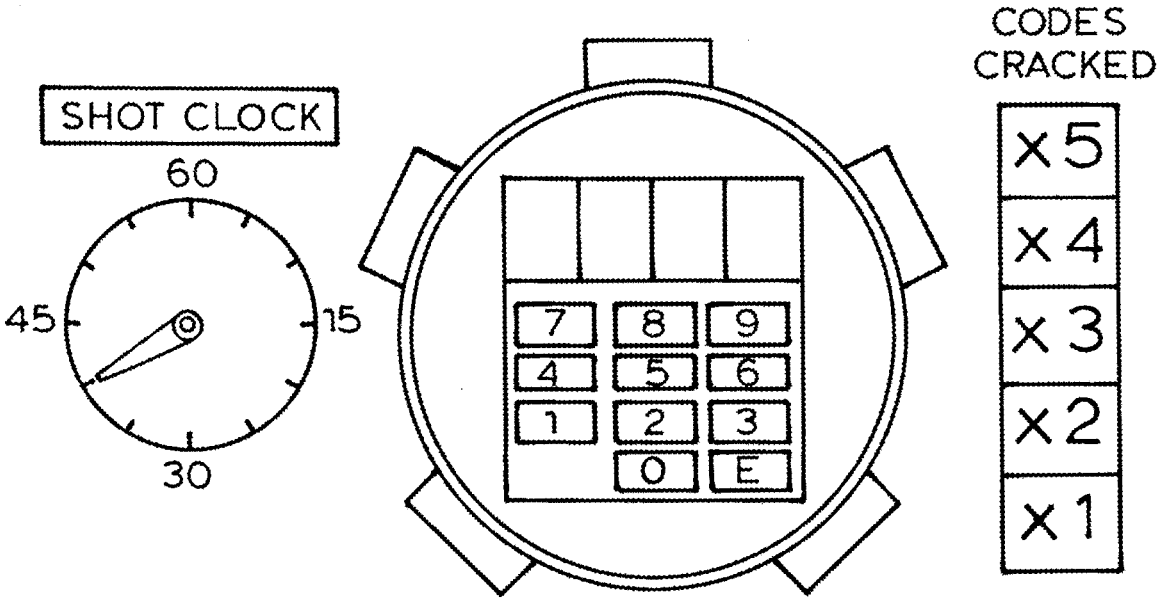

FIG. 5 schematically illustrates a screen shot of a strategy based game of skill;

FIG. 6 schematically illustrates a screen shot of a dexterity based game of skill.

Figure 1:
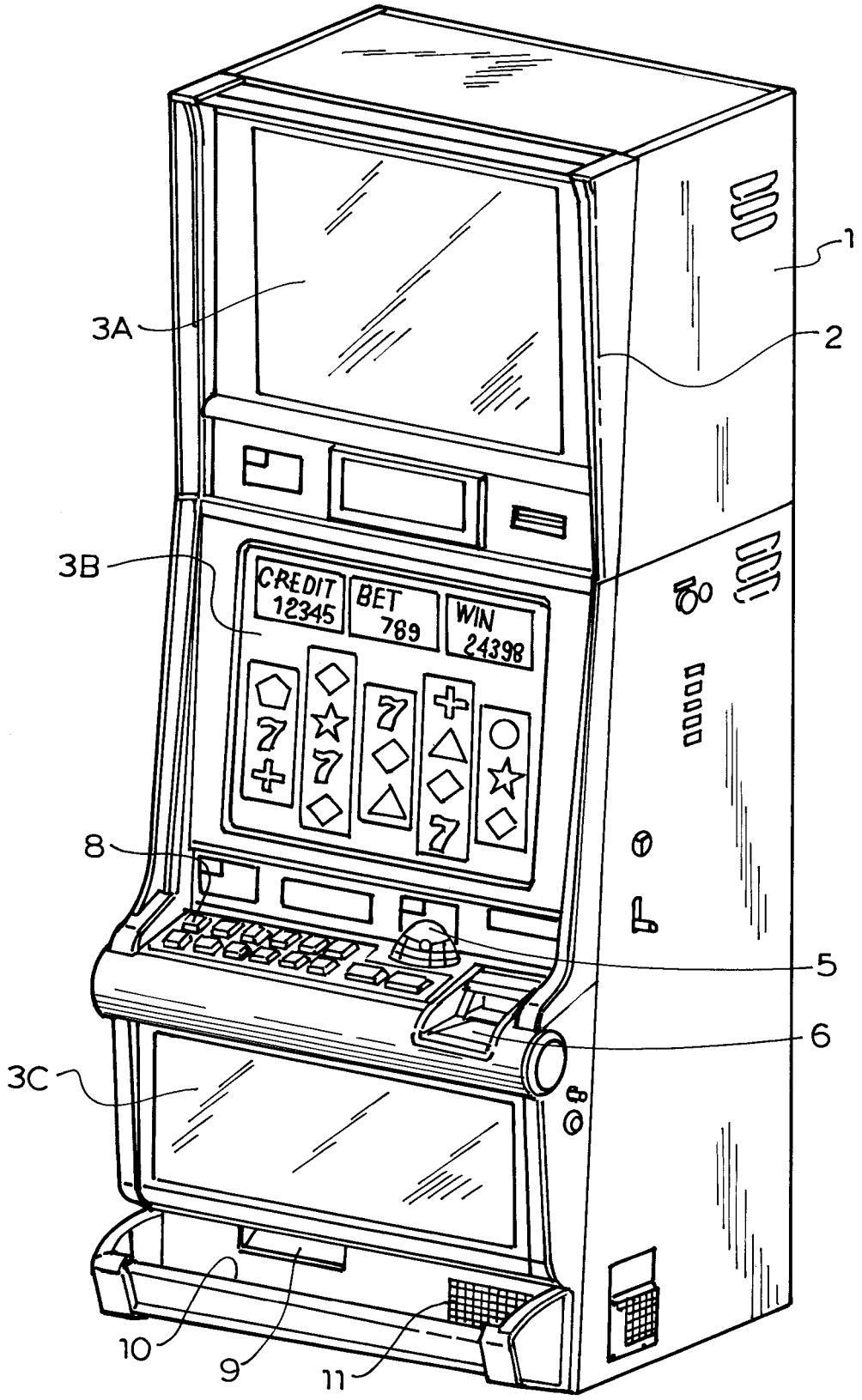
FIG. 1 depicts a typical electronic gaming machine for casino games.

As shown in FIG. 1 the gaming machine includes a player interface, a display screen for the games of chance and games of skill, a display screen for scores and game timer, a console for receiving player payments. Inside the cabinet is the game controller, and display controller.

In the following description the game of chance is a reels based game.

Playing time can be incrementally added to the game timer in a number of ways.

Event Triggered

During the course of the base game (a series of game elements) a game event may add a specified amount of time to the game timer. The amount of time will be determined by the algorithm. The event may be any event that occurs during the game of chance but is preferably any one of the following:

- a specific symbol combination on the reels
- a random probability driven event
- a specified number of game elements have been played
- a specified number of symbols from the reels game have been collected.

Figure 2A:
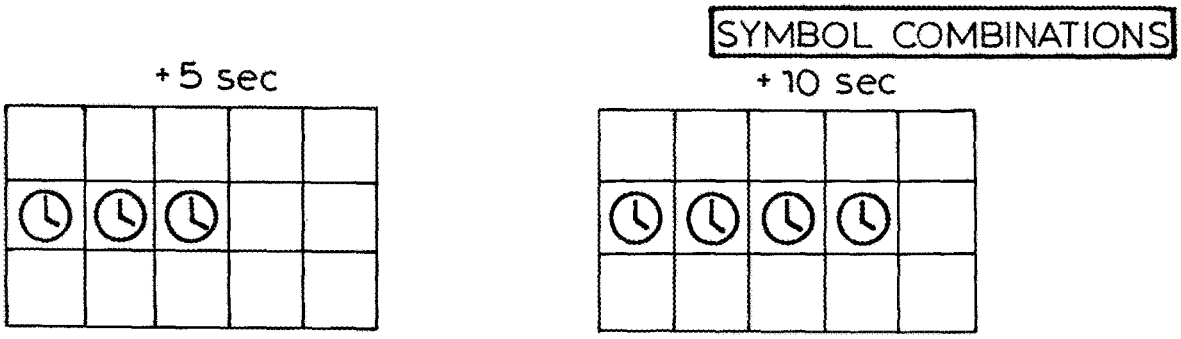
FIG. 2 illustrates a flow chart for incrementing the available time for a game of skill by triggering the increment when a specified event occurs in the game of chance.

FIG. 2A illustrates the incrementing of the game timer by the occurrence of a specific combination of icons (clock icons in this example).

Figure 2B:
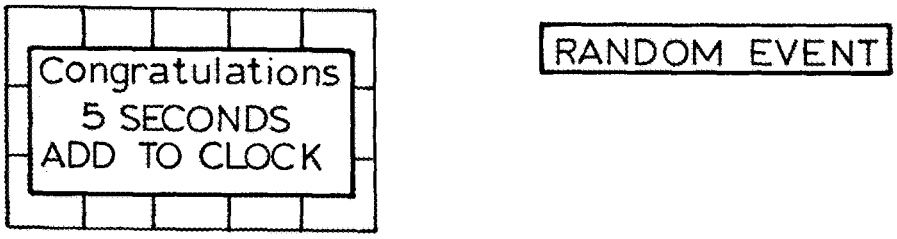

FIG. 2B illustrates the incrementing of the game timer by the occurrence of a random event generated by the RNG.

Figure 2C:
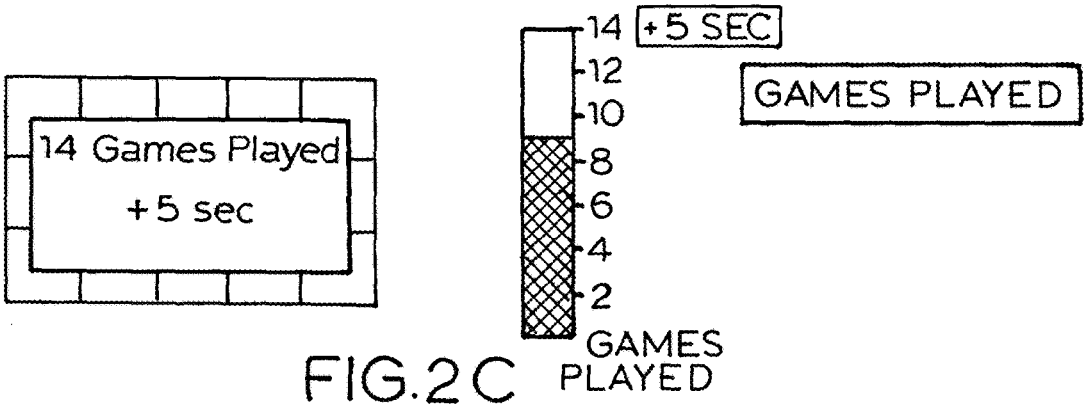
Figure 2D:
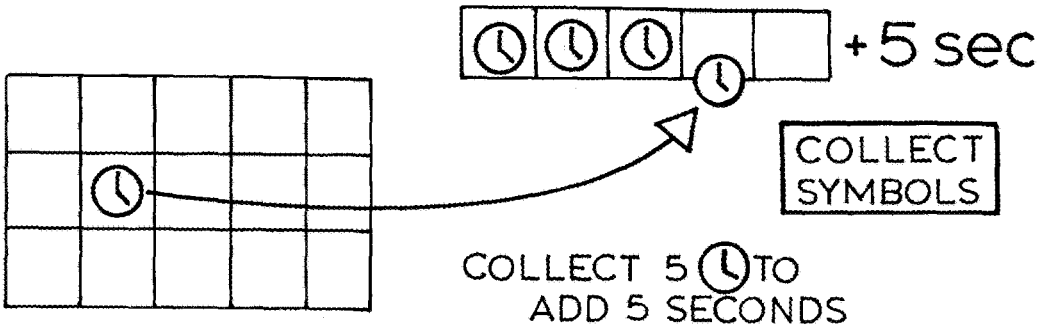

FIG. 2C illustrates the incrementing of the game timer by the conclusion of a specified number of games.

In each case the clock icon symbols are collected and displayed in the game timer display as shown in 2D.

The "feature" game of skill is displayed for playing based on the triggers illustrated in FIG. 4.

Figure 4A:
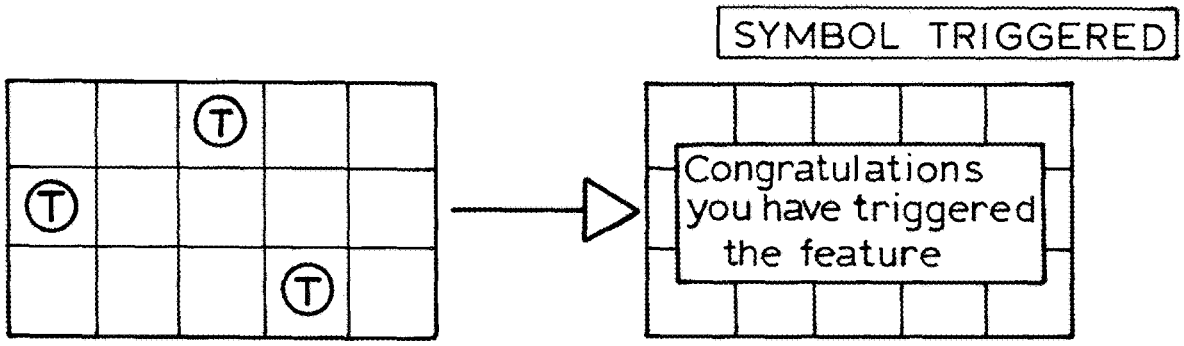
FIG. 4 illustrates a flow chart for triggering a game of skill.
Figure 4B:
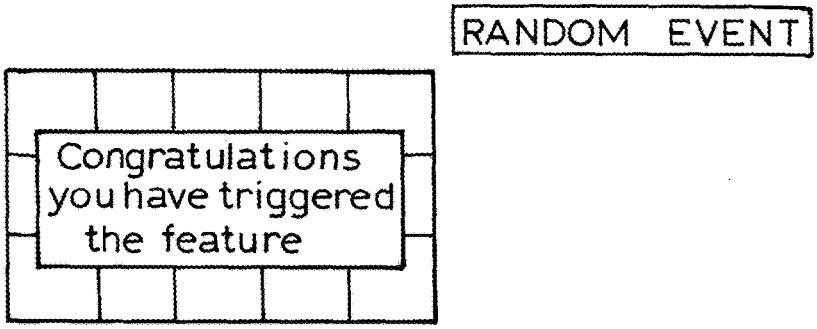
Figure 4C:
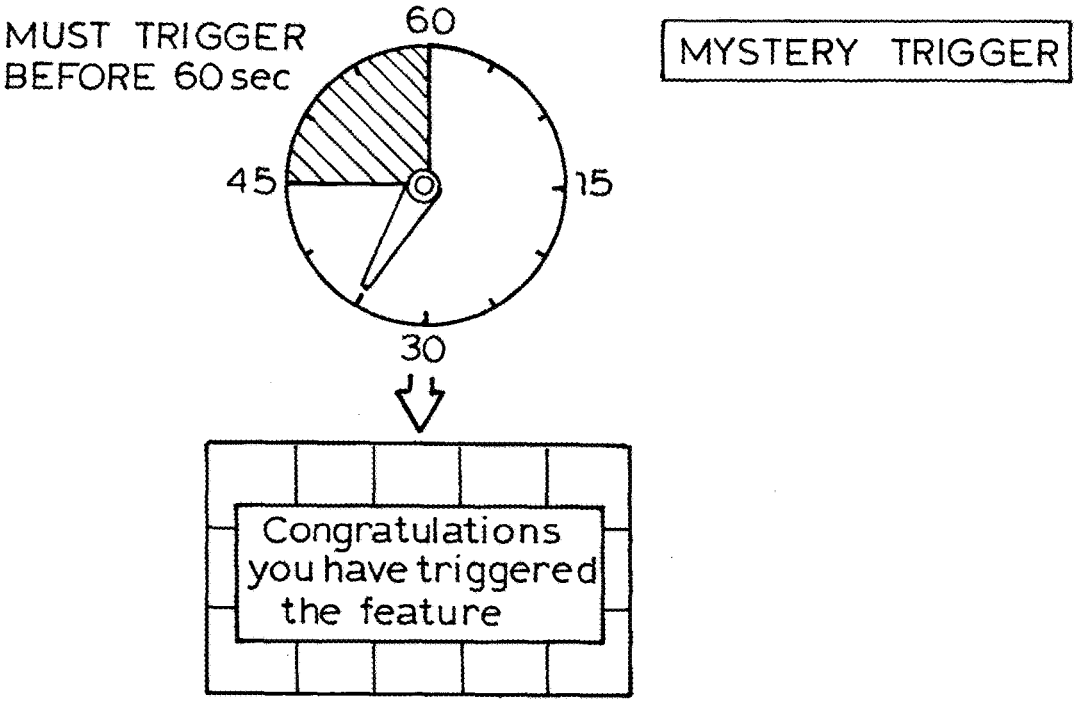

- Symbol triggered is shown in FIG. 4A where a specific icon combination appearing on the reels will trigger the start of the feature game of skill
- Random triggering based on a probability based single event driven by the RGN as shown in FIG. 4B
- By a mystery trigger as shown in FIG. 4C. the mystery trigger is calculated at the completion of the last feature game with a random time value chose to lie between the game timers minimum and maximum value (eg between 0 and 60 for an analogue game timer display.

Once the feature game of skill is triggered, the time allocated on the game timer display may also be incremented by the way in which the feature was triggered.

Figure 3A:
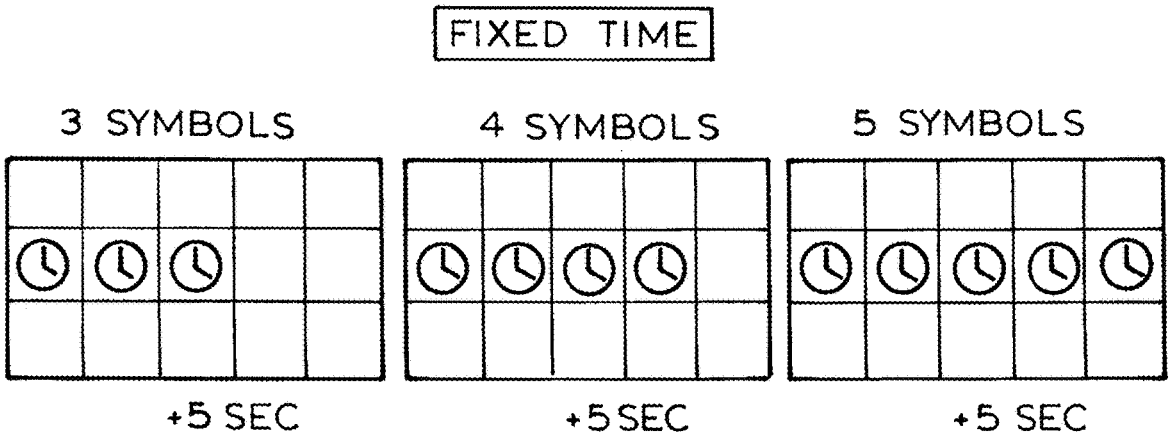
FIG. 3 illustrates a flow chart for incrementing the available time for a game of skill by triggering the increment when a specified event occurs in the game of skill.
Figure 3B:
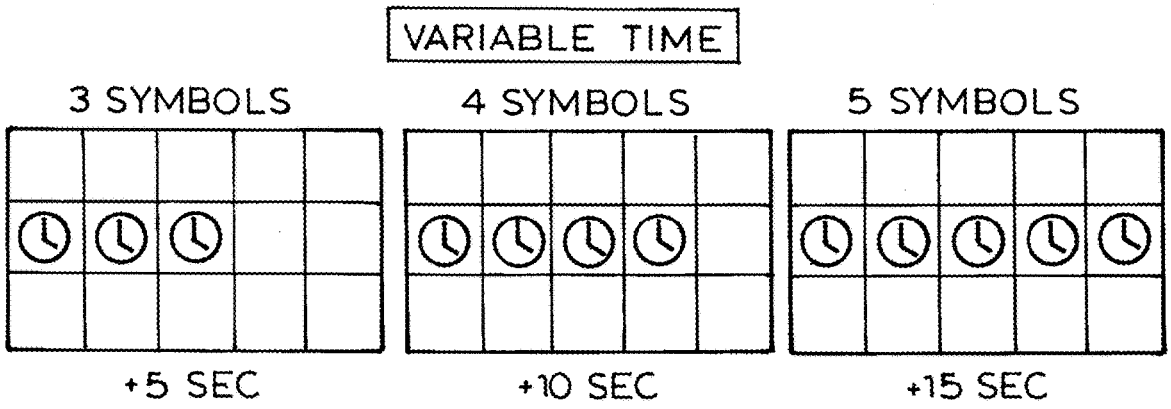
Figure 3C:
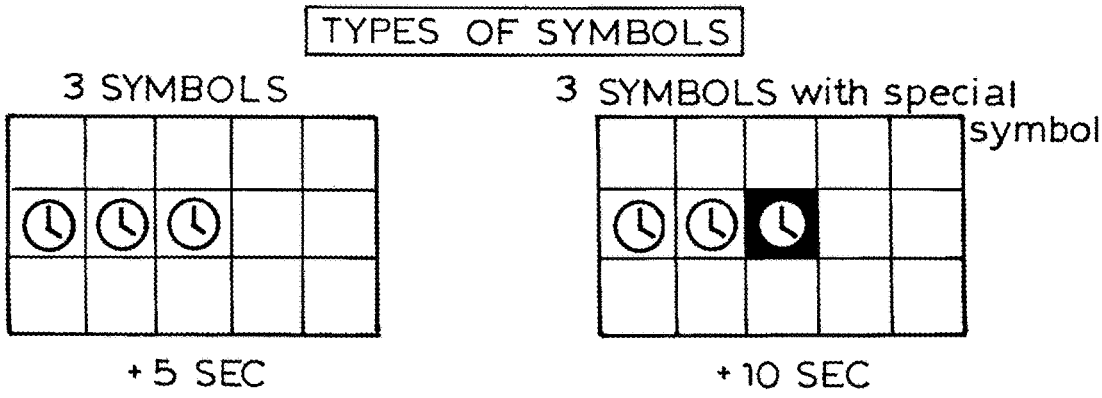

- The elapse of a fixed amount of time based on the triggering of the skill based game and displayed as shown in FIG. 3A
- a variable amount of time based on the number of trigger icons that triggered the feature game and displayed as shown in FIG. 3B
- be a variable amount of time based on the type of icons involved in triggering the feature game of skill. This is shown in FIG. 3C During the game of skill the score achieved within an allocated time may be used to increment the game timer with bonus playing time. This will be determined by the Algorithm. The manner of the event and the bonus playing time may be any means available and any time that is determined by the algorithm but is preferably any of the methods illustrated in FIGS. 2 and 3.

Once the feature game is triggered and is played in the game display space and the player initiates play, the game timer starts counting down. The feature game may be free games chance or preferably a game of skill. The feature game will be completed when the game timer counts down to a specified minimum or a maximum skill game result is achieved.

When the feature game is completed the game timer is reset to a start-up value and the incrementing process restarts. A hidden amount of time may be added based on events that have happened in the previous game play. Any time left on the game timer when the feature game finishes may be lost or carried over depending on the choices available within the algorithm parameters.

The game of skill may be a dexterity based game as illustrated in FIG. 5. In this game bubbles travel across the stream and the player can pop them by touching them. The player has the time displayed on the game timer to pop as many bubbles as possible. The popping of a bubble increments the skill score. The bubbles may have various values such as score rewards, or remove or add time to the game timer. The player obtains a skill score based on the incrementing of the score until the total playing time elapses or until a maximum score is achieved.

An example is described below in which the time based feature is called the pop clock and the skill game is called pop shots.

Rules for generating the time based feature

- The "Pop Clock" is a time based progressive
- The Pop Clock will start at 20 seconds
- For every clock symbol that appears on the reels during a game evaluation, 1 second will be added to the "Pop Clock"
- When the Pop Shots feature is triggered, the skill based game is played for the amount of time that is displayed on the Pop Clock at the point of trigger
- During the skill based game the clock will count down and when the clock reaches zero the skill feature is over Rules for the skill based game

- When the Pop Shots feature is triggered the player will play the Pop Shots skill game for the amount of time on the Pop Clock.
- During the skill based feature the aim is to pop as many bubbles as possible, with 1 point being added to their score for every bubble popped.
- There are multiplier bubbles that when popped will mean each subsequent bubble popped for the next 5 seconds will score 2 points instead of 1
- There are time add bubbles that will add an addition 5 seconds to the Pop Clock when popped
- There are chicken bubbles that when popped will prevent the player from popping any scoring bubbles until the player taps the on screen graphics multiple times to make the large chicken disappear.
- Once the Pop Clock has counted down to zero, the players score is then used to award the player a group of multipliers that are then applied during the free game sequence.

The game of skill may be a strategy based game and an example is shown in FIG. 6. A safe dial is shown and the player needs to key a 4 digit code having no repeated numbers in the code. The game screen may display the correct code numbers as they are keyed in the correct position, so that the player can select the remaining code elements from the numbers that have not been keyed.

For example when the correct number is in the correct position the number is locked in and is green. If the correct number is placed in the wrong position the number lights up as yellow. If a number that is not in the code is keyed it lights up as red.

In this game a maximum number of codes may be set at 5 so that when 5 different random codes are identified the game ends. However if the game timer counts down to zero before the maximum number is achieved the feature game is also concluded. Each time a code is entered, the time on the game timer will increment; and when a code is correctly identified the timer will increment.

The game ends when the game timer reaches zero or 5 codes have been cracked. The skill score is calculated using time on the timer and a multiplier which increases with each code that is correctly identified. Each time a code is identified the time remaining is multiplied by the current multiplier and added to the score display.

The skill based award for both types of skill games may be used to determine the monetary based prize the player has won.

The player may be awarded one of four bet proportional bonus prizes for example

Level 4 $5.00 based on a score within the range 0-50
Level 3 $10.00 based on a score within the range 51-1000
Level 2 $25.00 based on a score within the range 101-150
Level 1 $50.00 based on a score within the range 151+

Alternatively the reward may be an improved secondary feature experience. For example:

Level 4: 5 free games
Level 3: 10 free games
Level 2: 15 free games
Level 1: 20 free games In another alternative it may be a flat number of free games with the level dictating a multiplier for the value that could be won:

Level 4: 1×
Level 3: 2×
Level 2: 3×
Level 1: 5×

For each gaming machine, government regulations require that there be a minimum return to player (RTP) over the life if the machine and this is determined by an algorithm based on an RNG. An example of a regulated minimum return is 87% and the venue operator may be prepared to tolerate a maximum return to player that is higher for example up to 97%.

When the gaming machine includes the game of skill and the game timer arrangement of this invention the algorithm is modified to include a component which is a function of the time provided for additional games and the skill score. For example the Algorithm can be configured so that the RNG component provides a minimum RTP such as 80% and the game time function and skill score function provide the remainder, so that a basic skilled player would over the lifetime of the machine achieve the minimum regulated RTP whereas a more skilled player would approach the maximum RTP as set by the venue.

Those skilled in the art will appreciate that this invention provides a unique and advantageous means of improving the gaming experience.

Those skilled in the art will also realise that this invention may be implemented in embodiments other than those described without departing from the core teachings of this invention.

The invention claimed is:

1. A gaming machine which includes:

a display unit configured to display a gaming interface, and a score interface;

a console for receiving payment instructions from a player; a game controller programmed to present at least one game of chance said game controller including a random number generator, a score calculator and a timer;

a display controller activated by said game controller to display said game of chance and to display a score and a game timer;

said game controller including a program that runs an algorithm that determines that the long term return to player (RTP) from the gaming machine lies between a minimum specified percentage and a maximum specified percentage;

said algorithm including functions dependent on the random number generator (RNG), and the time provided for the game of chance, wherein the algorithm is arranged to provide a minimum RTP from the RNG component plus an additional time component for a player to achieve a higher RTP.

2. A gaming machine as claimed in claim 1 in which a game of skill is also provided and displayed for playing during the additional time rewarded to the player.

3. A gaming machine as claimed in claim 2 in which the game of skill is a game of dexterity or a strategy game.

4. A gaming machine which includes:

a display unit configured to display a gaming interface, and a score interface;

a console for receiving payment instructions from a player;

a game controller programmed to present at least one game of chance and at least one game of skill;

said game controller including a random number generator (RNG), a score calculator and a timer adapted for providing time for the game of chance and additional time for the at least one game of skill;

a display controller activated by said game controller to display at least one of said game of chance and one of said game of skill and to display a score and a game timer;

said game controller including a program that runs an algorithm that determines that the long term return to player (RTP) from the gaming machine lies between a minimum specified percentage and a maximum specified percentage;

said algorithm including functions dependent on the random number generator (RNG), the additional time provided for the game of skill and the score from the game of skill.

5. A gaming machine as claimed in claim 4 in which the game of skill is a game of dexterity or a strategy game.

* * * * *